US007571981B2

(12) United States Patent
Yamada

(10) Patent No.: US 7,571,981 B2
(45) Date of Patent: Aug. 11, 2009

(54) WASTE INK STORAGE STRUCTURE, INK CARTRIDGE, WASTE INK TANK AND INK JET PRINTER

(75) Inventor: Manabu Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 483 days.

(21) Appl. No.: 11/499,504

(22) Filed: Aug. 4, 2006

(65) Prior Publication Data

US 2007/0030304 A1 Feb. 8, 2007

(30) Foreign Application Priority Data

Aug. 4, 2005 (JP) ..... 2005-227166

(51) Int. Cl.
*B41J 2/165* (2006.01)

(52) U.S. Cl. ..... 347/36; 347/31; 347/35

(58) Field of Classification Search ..... 347/36, 347/34, 29, 33, 32, 31, 30, 35
See application file for complete search history.

(56) References Cited

U.S. PATENT DOCUMENTS 4,695,851 A 9/1987 Terasawa
5,831,647 A 11/1998 Kawakami et al.
6,261,911 B1 7/2001 Lee et al.
6,281,911 B1 8/2001 Nakazawa et al.

FOREIGN PATENT DOCUMENTS

| | | |
|---|---|---|
| EP | 1 498 272 A | 1/2005 |
| JP | 07-025020 | 1/1995 |
| JP | 8-112911 A | 5/1996 |
| JP | 8-318629 | 12/1996 |
| JP | 11-70672 | 3/1999 |
| JP | 2001-162829 | 6/2001 |
| WO | WO-96/34755 A | 11/1996 |

OTHER PUBLICATIONS

European Search Report issued Jan. 25, 2007, re: EP 06 01 6241.

*Primary Examiner*—Shih-wen Hsieh
(74) *Attorney, Agent, or Firm*—Edwards Angell Palmer & Dodge LLP; Catherine J. Toppin

(57) ABSTRACT

A waste ink storage structure including: container walls, defining a storage space adapted to store a waste ink; a waste ink inlet portion adapted to pour the waste ink into the storage space; a vent communicating the storage space with atmosphere; and a valve, provided at the vent to be opened when the waste ink is poured from the waste ink inlet portion.

29 Claims, 9 Drawing Sheets

WASTE INK STORAGE STRUCTURE, INK CARTRIDGE, WASTE INK TANK AND INK JET PRINTER

BACKGROUND OF THE INVENTION

1. Technical Field of the Invention

The present invention relates to a waste ink storage structure that stores waste ink to be generated by a head cleaning operation and so on, and to an ink cartridge, a waste ink tank and an ink jet printer having the same.

2. Description of the Related Art

In an ink jet printer, during a head cleaning operation to be performed in order to prevent degradation of print quality due to clogging of ink or during an ink filling operation after replacement of an ink cartridge, waste ink is generated. Accordingly, a waste ink storage structure that collects generated waste ink so as to prevent waste ink from being unexpectedly attached to mechanisms in the printer is required.

In the waste ink storage structure, in general, a storage space for storing waste ink is defined by container walls, and a waste ink inlet portion that pours waste ink into the storage space is provided at a portion of one of the container walls. Further, a vent connects the waste ink storage space to the outside at a position spaced from the waste ink inlet portion on the container wall so as to expose the waste ink storage space to the atmosphere. In addition, an ink absorption member that absorbs waste ink poured by the waste ink inlet portion is provided in the waste ink storage space. The waste ink storage structure may be incorporated into a case of the ink cartridge (for example, see JP-A-11-70672) or may be separately incorporated into a portion of a printer housing of an ink jet printer (for example, see JP-A-8-318629).

In the above-described waste ink storage structure, the vent that exposes the storage space to the atmosphere releases air in the storage space to the outside so as to prevent a pressure in the storage space from increasing due to the pouring of waste ink.

In the related waste ink storage structure, the vent is constantly exposed to the outside, and thus moisture of waste ink absorbed by the ink absorption member is always transpired from the vent to the outside.

As a result, in particular, when pigment-based ink is used, hardening of waste ink may easily occur, and hardened ink may degrade absorption capability of the ink absorption member. Accordingly, it may be impossible to fully utilize the original absorption capacity of the ink absorption member, and to stably use the ink absorption member for a long time. Further, a pressure in a waste ink supplying side tube connected to the waste ink inlet portion and so on may be abnormally increased due to clogging caused by hardened waste ink. Then, the tube may be removed due to the abnormal increase in pressure, which causes ink leakage.

SUMMARY OF THE INVENTION

Accordingly, the invention has been finalized in order to solve at least one of the above-described problems, and it is an object of at least one embodiment of the invention to provide a waste ink storage structure which can collect waste ink for a long time, and an ink cartridge, a waste ink tank and an ink jet printer having such a waste ink storage structure.

According to an aspect of at least one embodiment of the invention, a waste ink storage structure comprising: container walls, defining a storage space adapted to store a waste ink, and provided with a waste ink inlet portion adapted to pour the waste ink into the storage space and a vent communicating the storage space with atmosphere; a valve, provided at the vent to be opened when the waste ink is poured from the waste ink inlet portion.

According to the waste ink storage structure having this configuration, the vent that communicates the storage space to the atmosphere is kept in a closed state by the valve, excluding when waste ink is poured from the waste ink inlet portion.

Therefore, moisture of waste ink poured into the storage space is suppressed from being transpired from the vent to the outside, and thus it is possible to prevent hardening of waste ink in the storage space.

In the waste ink storage structure having the above-described configuration, the waste ink storage structure may further comprise an ink absorption member, provided in the storage space and adapted to absorb the waste ink.

According to the waste ink storage structure having the above-described configuration, the absorption capability of the ink absorption member is prevented from being degraded due to hardening of waste ink.

In the waste ink storage structure having the above-described configuration, the container walls may include a flexible container wall formed of a flexible sheet member provided with the vent, and the valve may have: the flexible container wall; and a valve structure member having a contact portion which comes into contact with a perimeter of the vent to block the vent, and be constructed such that the vent is opened when the perimeter of the vent displaces and separates from the contact portion by a pouring pressure of the waste ink poured from the waste ink inlet portion.

According to the waste ink storage structure having this configuration, the valve for opening/closing the vent can be obtained only by forming the vent to pass through the flexible sheet member constituting the container wall and integrally forming a support or a rib serving as the valve structure member in another container wall facing the vent. The vent perimeter of the valve is separated from the contact portion of the valve structure member by an expansion operation of the flexible sheet member due to the pouring pressure of waste ink from the waste ink inlet portion.

Therefore, parts for providing the valve do not need to be added, and thus costs can be prevented from being increased due to an increase in the number of parts or an increase in the number of assembling steps.

At the time of discarding the ink absorption member, one surface of the storage surface can be largely opened by removing the flexible sheet member, such as a plastic film or the like, having the vent from other container walls. Then, the ink absorption member having absorbed waste ink can be simply removed from the storage space.

The ink absorption member may be spaced away from the periphery of the contact portion of the valve structure member.

According to this configuration, since the contact portion and the ink absorption member are spaced apart from each other, a capillary force does not exert between them, and thus ink absorbed by the ink absorption member does not exude to the contact portion. Therefore, there is no case where waste ink flows out from the vent.

The vent may be disposed on a central line of short side in the flexible container wall. In this case, displacement becomes the maximum, and thus an operation pressure as a valve can be reduced. Further, since displacement at the vent of the flexible container wall is balanced on the sides thereof, the vent perimeter can be uniformly brought into contact with the contact portion.

In the waste ink storage structure according to this configuration, the contact portion of the valve structure member may be provided with a protrusion passing through the vent of the flexible sheet member.

According to this configuration, positioning of the contact portion of the valve structure member and the vent of the flexible sheet member is easily performed at the time of assembly, and thus assembly workability can be improved.

A valve body of the valve to block the vent may be integrally formed with an elastic member having an open-close portion elastically displacable in an opening direction by a pouring pressure of the waste ink poured from the waste ink inlet portion According to this configuration, an exclusive-use valve body constituting the valve needs to be provided. However, by suitably setting elasticity in the open/close portion of the valve body, sealing capability of the vent by the valve can be improved, and also the capability to prevent transpiration of moisture from the vent can be improved. Further, the container wall having the vent provided therein is not limited to the flexible sheet member, such as a plastic film or the like. Therefore, a degree of freedom for design of an ink cartridge or a printer housing having the waste ink storage structure can be improved.

According to another aspect of at least one embodiment of the invention, an ink cartridge includes the waste ink storage structure having the above-described configuration and an ink pack adapted to store ink therein.

According to the ink cartridge having this configuration, moisture of waste ink poured into the storage space is suppressed from being transpired from the vent to the outside. Therefore, it is possible to obtain an ink cartridge that can prevent hardening of waste ink in the storage space and can prevent absorption capability of the ink absorption member from being degraded due to hardening of waste ink.

In the ink cartridge having the above-described configuration, the container walls may include a flexible container wall formed of a flexible sheet member provided with the vent, and the flexible container wall defines an accommodating space accommodating the ink pack and the storage space.

According to this configuration, the vent is not directly exposed the outside of the ink cartridge, but communicates with the atmosphere through the accommodating space for accommodating the ink packs. Therefore, the situation in which a user unexpectedly touches the valve provided at the vent, which causes a trouble in valve functions, can be prevented.

In the ink cartridge having the above-described configuration, the vent may be provided at a position that does not interfere with the ink pack.

According to this configuration, the ink packs accommodated in the accommodating space of the ink cartridge do not interfere with the valve functions of the valve provided at the vent.

When ink is pigment-based ink, hardening prevention effects of waste ink in the storage space can be markedly achieved.

According to still another aspect of at least one embodiment of the invention, an ink jet printer includes the ink cartridge having the above-described configuration.

According to the ink jet printer having this configuration, moisture of waste ink poured into the storage space is suppressed from being transpired from the vent to the outside. Therefore, it is possible to obtain an ink jet printer that can prevent the hardening of waste ink in the storage space and can prevent absorption capability of the ink absorption member from being degraded due to hardening of waste ink.

According to a further aspect of at least one embodiment of the invention, a waste ink tank includes the waste ink storage structure having the above-described configuration.

According to the waste ink tank having this configuration, moisture of waste ink poured into the storage space is suppressed from being transpired from the vent to the outside. Therefore, it is possible to obtain a waste ink tank that can prevent hardening of waste ink in the storage space and can prevent the absorption capability of the ink absorption member from being degraded due to hardening of waste ink.

The waste ink tank may be detachably mounted in a tank accommodating portion of a printer housing.

According to this configuration, only the waste ink tank can be independently removed from the printer housing. Therefore, only the waste ink tank that is stained with ink can be separately managed, and the non-stained printer housing can be recycled or reused as it is. In addition, since the waste ink tank is detachably provided, in a certain situation, a worker can replace only the waste ink tank with a new one without staining his/her hands.

According to the waste ink storage structure, and the ink cartridge, the waste ink tank and the ink jet printer having the waste ink storage structure of the invention, the vent communicating the storage space for storing waste ink with the atmosphere is kept in a closed state by the valve excluding when waste ink is poured from the waste ink inlet portion.

Therefore, moisture of waste ink poured into the storage space is suppressed from being transpired from the vent to the outside. Therefore, it is possible to prevent hardening of waste ink in the storage space, and in case where the absorption member is provided in the waste ink storage structure, also to prevent the absorption capability of the ink absorption member from being degraded due to hardening of waste ink.

As a result, original absorption capability of the ink absorption member can be fully utilized, and the ink absorption member can be stably used to collect waste ink for a long time. Further, since clogging due to hardened waste ink does not occur, the situation in which a pressure in a waste ink supplying side tube connected to the waste ink inlet portion is abnormally increased is prevented. Therefore, the occurrence of an inconsistency, such as light leakage or the like, due to the removal of the tube or the like can be prevented.

BRIEF DESCRIPTION OF THE DRAWINGS

FIGS. 6A to 6C are cross-sectional views illustrating opening and closing operations of a valve shown in FIG. 4, in which FIG. 6A is a cross-sectional view showing a state where the valve is closed, FIG. 6B is a cross-sectional view showing a state where the valve is opened due to an increase in pressure within a storage space by the pouring of waste ink, and FIG. 6C is a cross-sectional view showing a state where the pouring of waste ink ends and the valve is closed again;

DETAILED DESCRIPTION OF THE INVENTION

Hereinafter, a waste ink storage structure according to a first embodiment of the invention will be described in detail with reference to the accompanying drawings.

Figure 1:
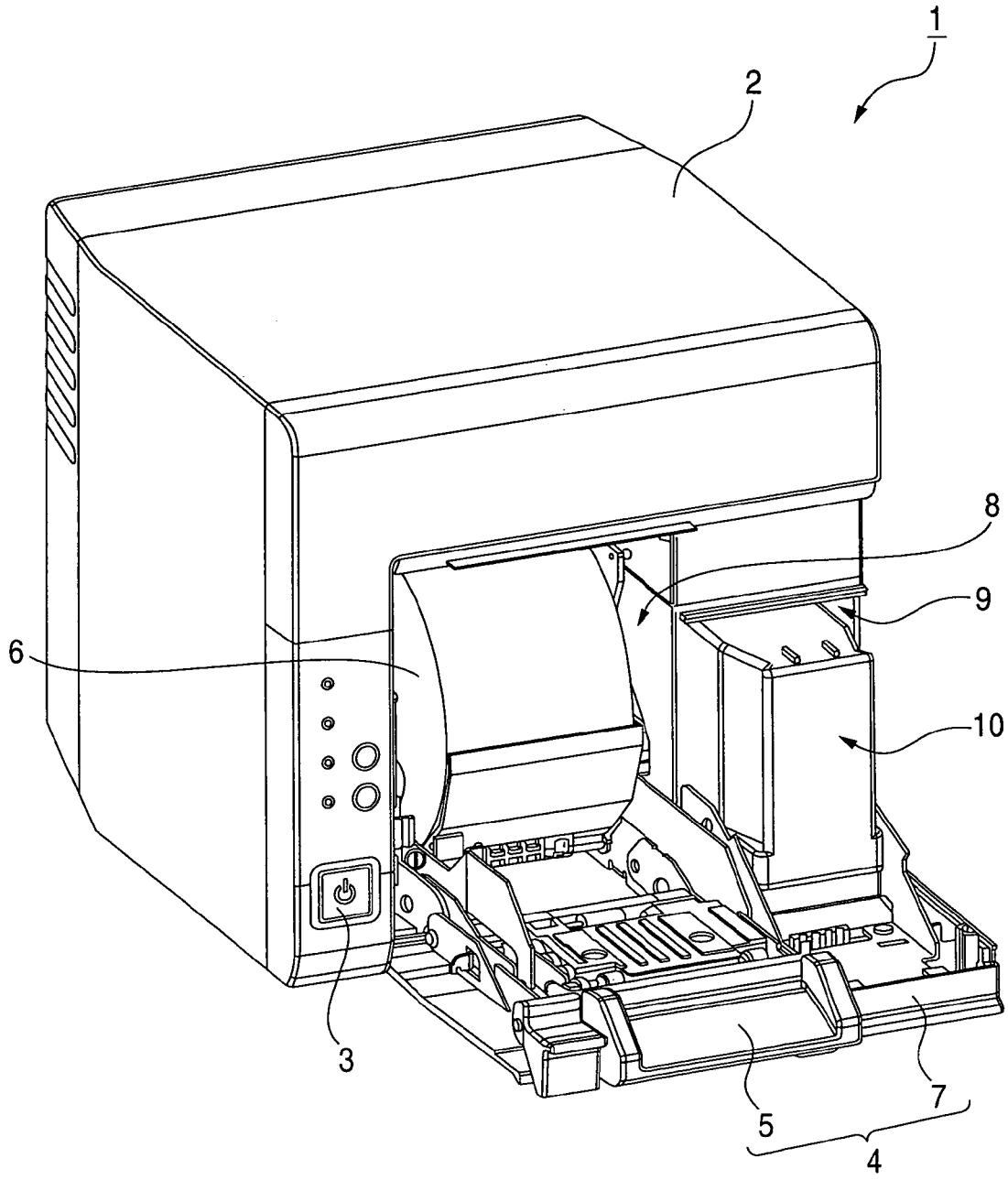
FIG. 1 is an exterior perspective view showing the overall configuration of an ink jet printer on which an ink cartridge having a waste ink storage structure according to an embodiment of the invention is mounted.
Figure 2:
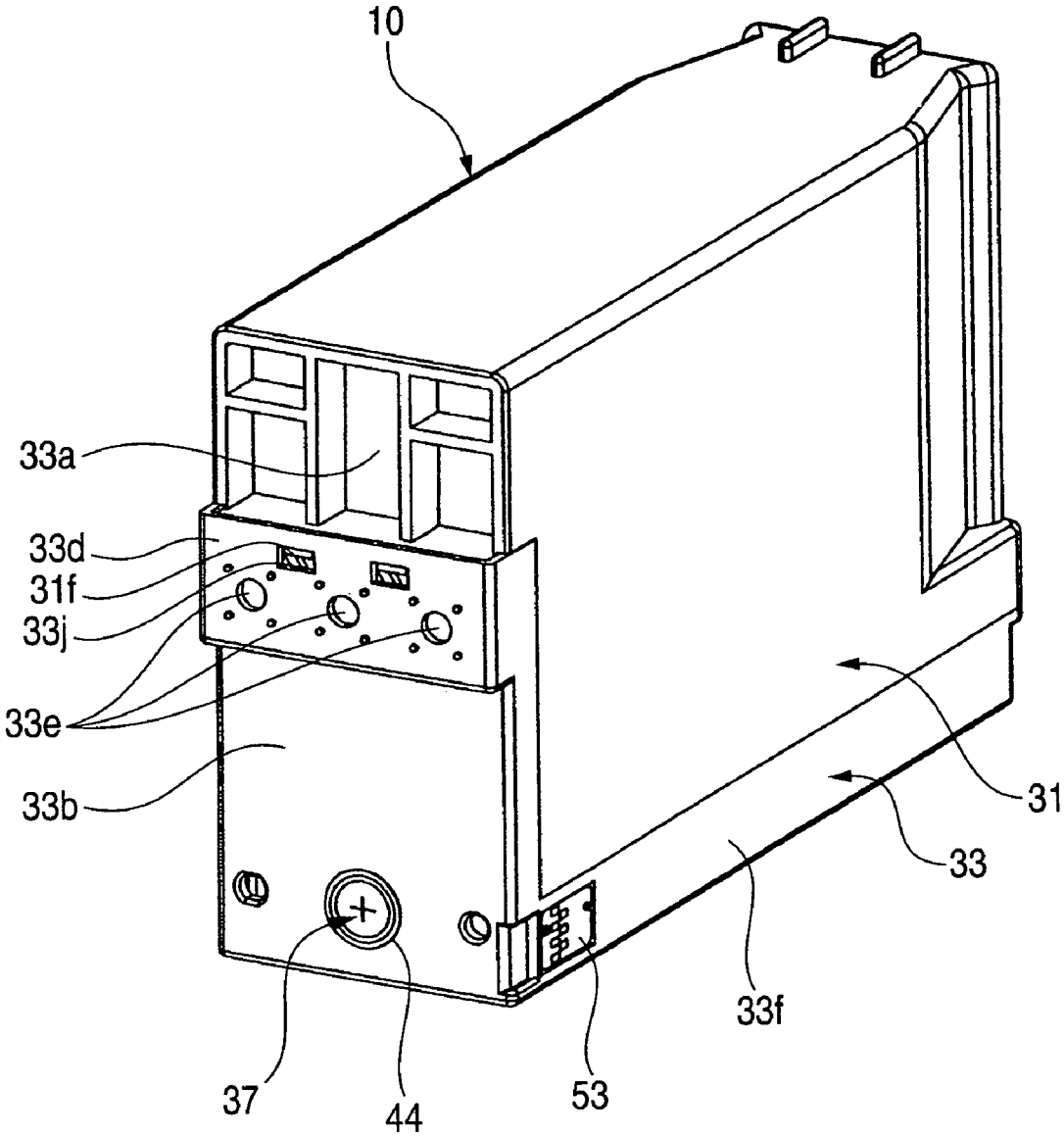
FIG. 2 is an overall perspective view of the ink cartridge shown in FIG. 1.
Figure 3:
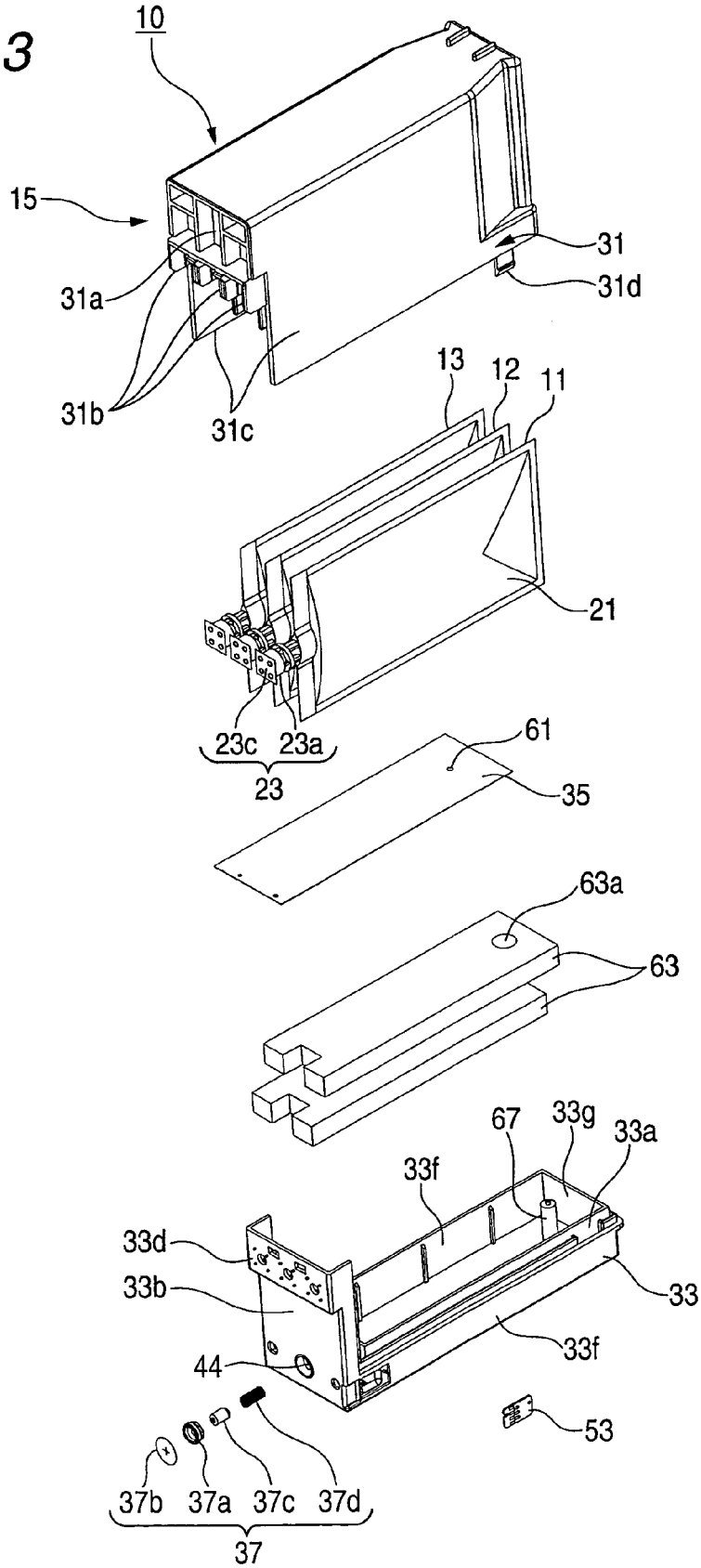
FIG. 3 is an exploded perspective view of the ink cartridge shown in FIG. 2.
Figure 4:
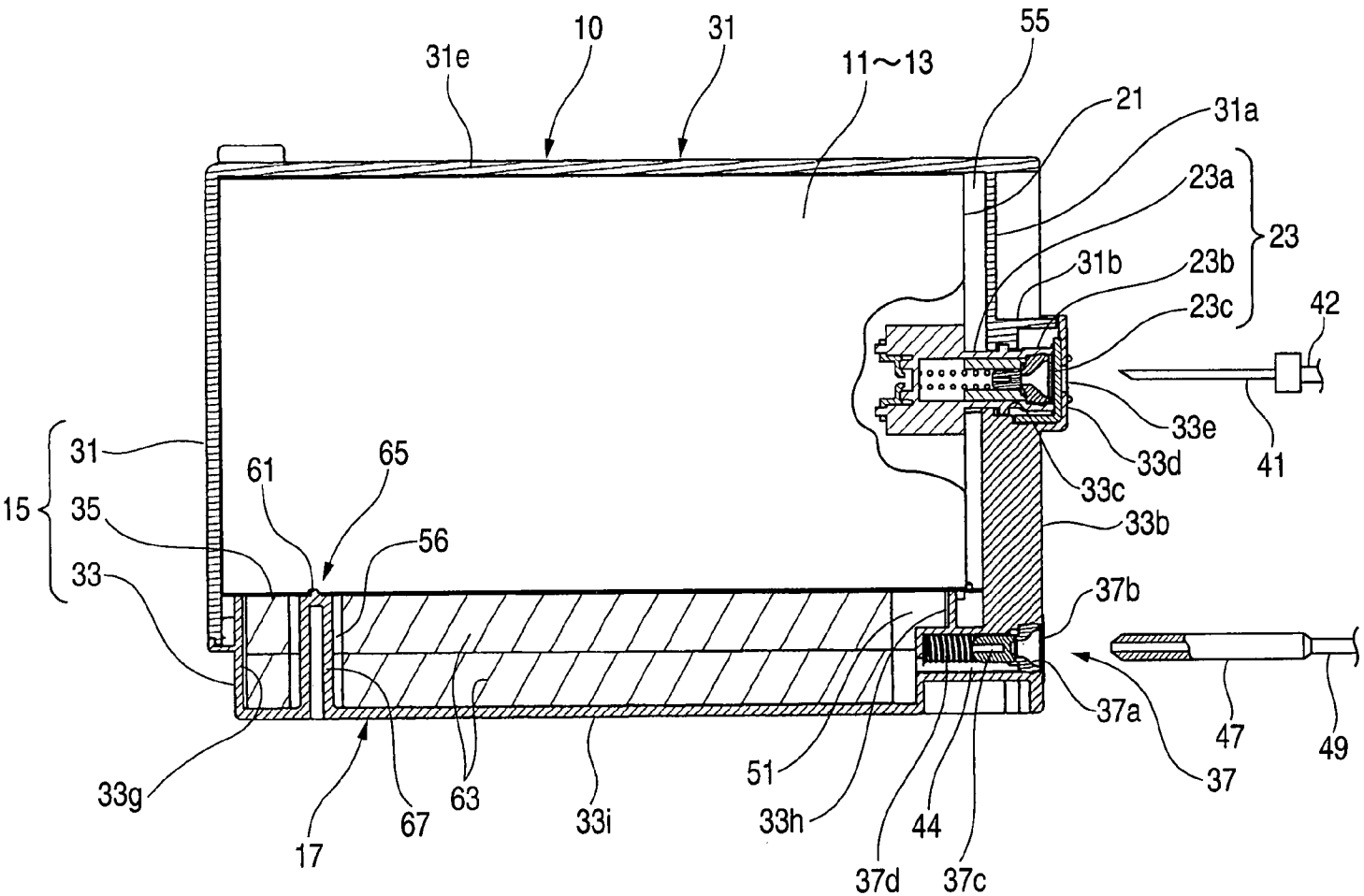
FIG. 4 is a longitudinal cross-sectional view of the ink cartridge shown in FIG. 2.

FIG. 1 is an exterior perspective view showing the overall configuration of an ink jet printer on which an ink cartridge having a waste ink storage structure according to the embodiment of the invention is mounted. FIGS. 2 to 4 are an overall perspective view, an exploded perspective view, and a longitudinal cross-sectional view of the ink cartridge shown in FIG. 1, respectively. FIGS. 5 and 6A to 6C are expanded cross-sectional views showing essential parts of the ink cartridge shown in FIG. 2.

An ink jet printer 1 according to this embodiment performs color printing on a roll paper using a plurality of color ink liquids. As shown in FIG. 1, a printer cover 4 having a roll paper cover 5 and an ink cartridge cover 7 integrally formed is openably provided on a front surface of a printer case 2. In addition, a power supply switch 3 and feed switches or indicators are disposed on the front surface of the printer case 2.

As shown in FIG. 1, if the printer cover 4 is opened, the roll paper cover 5 that covers a paper accommodating portion 8 for accommodating the roll paper 6 as a printing paper is opened, such that the papers can be replaced. At the same time, the ink cartridge cover 7 that covers a cartridge mounting portion 9 is also opened, such that an ink cartridge 10 can be attached and detached to and from the cartridge mounting portion 9.

In case of the ink jet printer 1 of this embodiment, the ink cartridge 10 is drawn out by a predetermine distance in front of the cartridge mounting portion 9 in connection with an opening operation of the printer cover 4.

As shown in FIGS. 2 to 4, the ink cartridge 10 of this embodiment is mounted on the cartridge mounting portion 9 of the ink jet printer 1. Accordingly, a waste ink storage structure 17 that stores waste ink generated at the time of an ink filling operation or a head cleaning operation of the printer is provided in a cartridge case 15 that accommodates three ink packs 11 to 13.

The three ink packs 11 to 13 are filled with ink of difference colors for color printing. The ink packs 11 to 13 have the same structure. Each of the ink packs 11 to 13 has a flexible pouch body 21 that contains ink, and an ink outlet port 23 that is bonded to a front end of the pouch body 21.

The pouch body 21 is formed by superimposing two aluminum-laminated films and bonding their peripheries to each other using a heat welding method or the like. The aluminum-laminated film is used to improve gas barrier characteristics. As the aluminum-laminated film, for example, a laminated film obtained by laminating a nylon film and a polyethylene film on both surfaces of an aluminum foil is used.

The ink outlet port 23 has a cylindrical body 23*a* that is formed to have an outer diameter larger than the diameter of its front end and is fixed within the pouch body 21, a valve body 23*b* that is mounted within the cylindrical body 23*a* so as to open/close a flow passage of the cylindrical body 23*a*, and a seal film 23*c* that is attached to the front end of the cylindrical body 23*a* so as to seal an opening of the cylindrical body 23*a*, as shown in FIG. 4. The cylindrical body 23*a* of the ink outlet port 23 is formed of, for example, hard plastic. Further, the seal film 23*c* is formed of a polyethylene film.

The cylindrical body 23*a* is fixed to the aluminum-laminated film of the pouch body 21 by heat welding or the like, such that the ink outlet port 23 is integrated with the pouch body 21.

As shown in FIGS. 3 and 4, the cartridge case 15 has an upper case 31, a lower caser 33 that is connected to the bottom of the upper case 31, and an intermediate container wall 35 that vertically divides a space defined by the upper case 31 and the lower case 33.

The upper case 31 and the lower case 33 are mold products formed of suitable plastic materials. The intermediate container wall 35 is formed of a plastic film serving as a flexible sheet member. In this embodiment, a plastic film having sufficient flexibility so as to be expanded upwardly by a pouring pressure of waste ink from a waste ink inlet portion 37 is selected.

The upper case 31 is in a box shape having a bottom opened and a front container wall 31*a* thereof is set to be lower than side container walls and a rear container wall. Then, semicircular cylindrical ink pack positioning portions 31*b* are formed below the front container wall 31*a* so as to position upper halves of the ink outlet ports 23 of the individual ink packs 11 to 13. Three semicircular cylindrical ink pack positioning portions 31*b* are formed to correspond to the three ink packs 11 to 13 to be accommodated.

An anchoring protrusion 31*f* of the upper case 31 is engaged with an anchoring opening 33*j* provided in a cover portion 33*d*, and anchoring protrusions 31*d* provided on both sides of the upper case 31 are anchored to stepped engagement portions (not shown) provided within anchoring slits 33*a* of the lower case 33, such that the upper case 31 and the lower case 33 are connected to each other.

The lower case 33 is in a thin pan and box shape having an open top. A front container wall 33*b* is set to be higher than side container walls and a rear container wall. Semicircular cylindrical ink pack positioning portions 33*c* are formed at an upper end of the front container wall 33*b* so as to position lower halves of the ink outlet ports 23 of the individual ink packs 11 to 13.

As shown in FIG. 3, the semicircular cylindrical ink pack positioning portions 33*c* position and fix the ink outlet ports 23 of the individual ink packs 11 to 13, together with the semicircular cylindrical ink pack positioning portions 31*b*, by clamping the individual ink outlet ports 23 from the above and below. Like the above-described ink pack positioning portions 31*b*, three semicircular cylindrical ink pack positioning portions 33*c* are formed to correspond to the three ink packs 11 to 13 to be accommodated.

The cover portion 33*d* is formed at an upper end of the front container wall 33*b* to extend from the front ends of the ink pack positioning portions 33*c* so as to cover the fronts of the ink outlet ports 23. As shown in FIG. 4, openings 33*e* are formed in the cover portion 33*d* to pass through the cover portion 33*d*. Then, ink supply needles 41 provided in the cartridge mounting portion 9 of the ink jet printer 1 are inserted into the openings 33*e*.

Three openings 33*e* are formed to be correspondingly concentric with the three semicircular cylindrical ink pack positioning portions 33*c*.

A waste ink inlet 44 is formed at a position in a lower portion of the container wall 33*b* to constitute the waste ink inlet portion 37 in the waste ink storage structure 17.

As shown in FIGS. 3 and 4, the waste ink inlet portion 37 has a tapered tube-shaped rubber mouth member 37*a* having a wider inner diameter at its front end, a seal film 37*b* that is heat-welded to the front container wall 33*b* so as to prevent separation of the rubber mouth member 37*a*, a valve body 37*c* that comes into contact with a rear end of the rubber mouth member 37*a* so as to close an opening of the rubber mouth member 37*a*, and a compressed coil spring 37*d* that biases the valve body 37*c* in a direction to be brought into contact with the rubber mouth member 37*a*.

The rubber mouth member 37*a* is press-fitted into the waste ink inlet 44 in a state where the compressed coil spring 37*d* is slightly compressed. As shown in FIG. 4, in a state where a waste ink pouring needle 47 is not inserted, the rubber mouth member 37*a* and the valve body 37*c* are kept airtight.

As shown in FIG. 4, the waste ink storage structure 17 of this embodiment has a storage space 51 that is defined by the lower case 33 and the intermediate container wall 35 and stores waste ink, the waste ink inlet portion 37 that pours waste ink into the storage space 51, a vent 61 that connects the storage space 51 to the outside, two ink absorption members 63 that are provided within the storage space 51 so as to absorb waste ink poured into the storage space 51 from the waste ink inlet portion 37, and a valve 65 that opens/closes the vent 61. The ink absorption members 63 are molded in a rectangular shape using liquid absorbent materials so as to be accommodated within the storage space 51. As a specific material, in addition to a porous material, such as sponge or nonwoven fabric, an absorbent polymer can be used.

After the two ink absorption members 63 are set on the lower case 33, the intermediate container wall 35 that can be formed of a plastic film (flexible sheet member), such as a polyethylene film or the like, is set such that its circumferential portion is superimposed on the upper end surfaces of the side container wall 33*f* and the front and rear container walls 33*g* and 33*h* of the lower case 33. Then, the superimposed portions are bonded using a heat welding method or the like, such that the ink absorption members 63 are fixed to the lower case 33 while being slightly tensioned.

The intermediate container wall 35 is fixed to the lower case 33 so as to cover an upper opening of the lower case 33. Then, as shown in FIG. 4, the storage space 51 constituting the waste ink storage structure 17 is defined between a bottom wall 33*i* of the lower case 33 and the intermediate container wall 35. In addition, an ink pack accommodating space 55 that accommodates the three ink packs 11 to 13 upright is defined between a top wall 31*e* of the upper case 31 and the intermediate container wall 35.

In this embodiment, a valve structure member 67 is provided within the storage space 51.

The valve structure member 67 that is a cylindrical structure is integrally formed to protrude from the bottom wall 33*i* of the lower case 33 at a position on a central line in a widthwise direction of the storage space 51. The valve structure member 67 has a contact surface 67*b* at a position having the same height as or slightly higher than those of the upper end surfaces of the side container wall 33*f* and the front and rear container walls 33*g* and 33*h*, to which the intermediate container wall 35 is to be welded. Further, a positioning protrusion 67*a* having a diameter smaller than the contact surface 67*b* is provided at the center of the upper portion of the valve structure member 67.

The total height of the two ink absorption members 63 provided in the storage space 51 is the same as or slightly lower than those of the upper end surfaces of the side container wall 33*f* and the front and rear container walls 33*g* and 33*h*. In addition, openings 63*a* are formed to pass through the ink absorption members 63 such that the ink absorption members 63 are disposed to be spaced by a gap from the valve structure member 67.

Meanwhile, the circular vent 61 is formed in the intermediate container wall 35 to face the contact surface 67*b* to be then closed by the contact surface. The vent 61 is disposed on the central line in the widthwise direction.

The contact surface 67*b* of the valve structure member 67 and the vent 61 of the intermediate container wall 35 constitute the valve 65 to be described below.

Preferably, a position where the valve 65 is to be formed is a position in which the waste ink finally reaches the storage space 51. In this embodiment, as shown in FIG. 3, the vent 61 and the valve structure member 67 are provided at positions in the periphery of the rear end so as not to interfere with the lower ends of the ink packs 11 to 13 and so as to be spaced apart from the waste ink inlet portion 37.

In this embodiment, the vent 61 is used to position where the circumferential portion of the intermediate container wall 35 is bonded to the lower case 33. That is, the portions to be bonded can be accurately positioned only by inserting the positioning protrusion 67*a* into the vent 61, and aligning the circumferential portion opposite to the vent 61 with the end surfaces of the lower case 33 to be bonded.

Figure 6A:
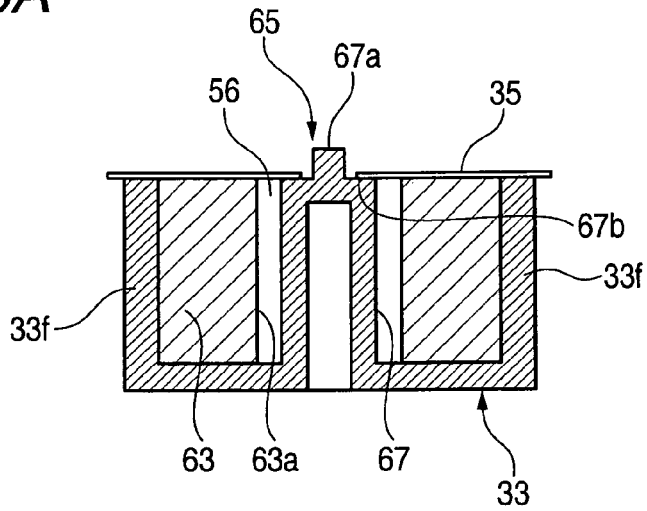

With this configuration, the circumferential portion of the vent 61 in the intermediate container wall 35 bonded to the lower case 33 comes into contact with the contact surface 67*b* of the valve structure member 67. Then, the vent 61 is closed, as shown in FIG. 6A.

As shown in FIGS. 2 and 3, in the lower case 33, an IC module 53 that can record the types of the ink packs 11 to 13, a residual ink quantity, and other kinds of data is provided on the side container wall 33*f*.

If the ink cartridge 10 is mounted on the cartridge mounting portion 9 of the ink jet printer 1 (see FIG. 1), the IC module 53 is electrically connected to a connection terminal provided in the cartridge mounting portion 9. Accordingly, information can be read and written from and into a printer control circuit or a computer to which the printer is connected.

If the lower case 33 shielded by the intermediate container wall 35 after the ink absorption members 63 are provided in the storage space 51 is joined to the upper case 31 that accommodates the ink packs 11 to 13, the upper case 31 and the lower case 33 are connected to each other by the above-described anchoring protrusions 31*d* and 31*f* and so on. With this procedure, the ink cartridge 10 is assembled.

Figure 5:
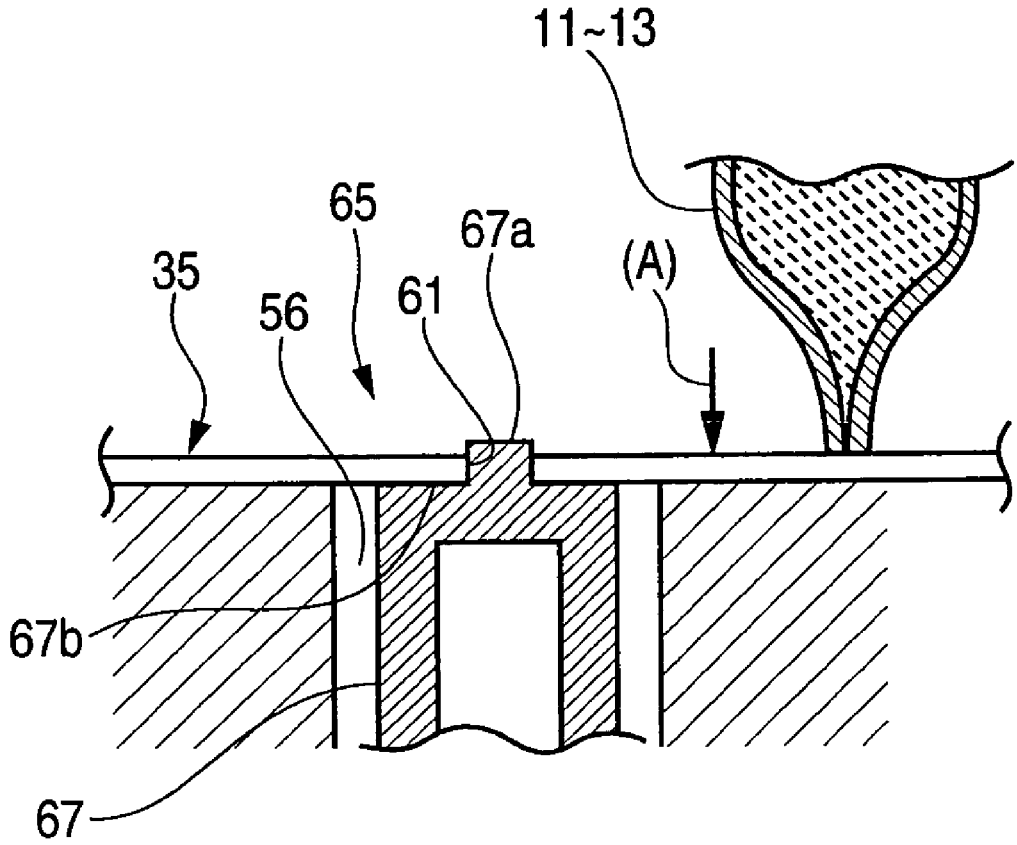
FIG. 5 is an expanded cross-sectional view showing essential parts of the ink cartridge shown in FIG. 2.

In a state where the ink cartridge 10 is mounted on the cartridge mounting portion 9 (see FIG. 1) of the ink jet printer 1, as shown in FIG. 5, the lower ends of the individual ink packs 11 to 13 press and bias the intermediate container wall 35 downward in a direction of an arrow (A) in the drawing. A pressing and biasing force can function as a biasing force for keeping the valve 65 of the waste ink storage structure 17 to be described below to be in a closed state. In this case, the intermediate container wall 35 can be fixed to the lower case 33 with no tension.

Next, the valve having the above-described configuration will be described in detail.

As shown in FIG. 6A, the valve 65 closes the vent 61 by causing the contact surface 67*b* of the valve structure member 67 to come into contact with the perimeter of the vent 61. The valve 65 is kept in a closed state excluding when waste ink is poured from the waste ink inlet portion 37 (see FIG. 4).

Figure 6B:
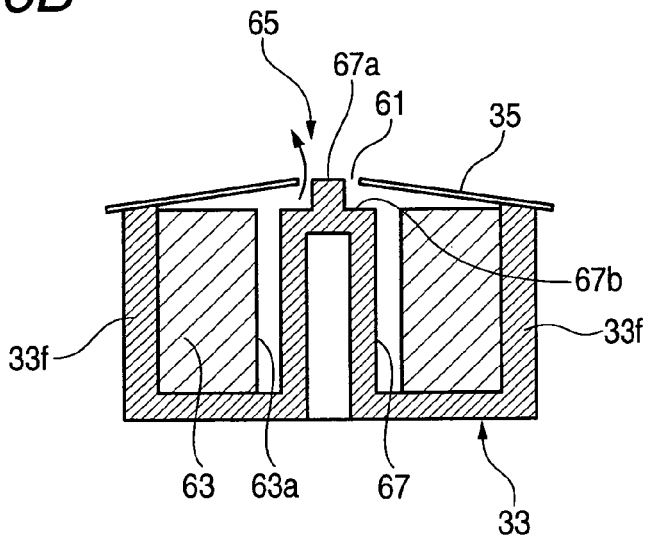

If a pressure within the storage space 51 increases according to the pouring of waste ink, as shown in FIG. 6B, the intermediate container wall 35 of the valve 65 is displaced and expanded upward. Then, the perimeter of the vent 61 is spaced away from the contact surface 67*b* of the valve structure member 67, and thus the valve 65 allows the storage space 51 to be exposed to the atmosphere through the vent 61.

Since the vent 61 is disposed on the central line in the widthwise direction, displacement of the intermediate container wall 35 becomes large, and thus an operation pressure as the valve is being reduced. Accordingly, an increase in internal pressure of the storage space 51 is easily prevented. In addition, since displacement at the vent 61 of the intermediate container wall 35 is balanced, the perimeter of the vent 61 can uniformly come into contact with the contact surface 67*b*.

Figure 6C:
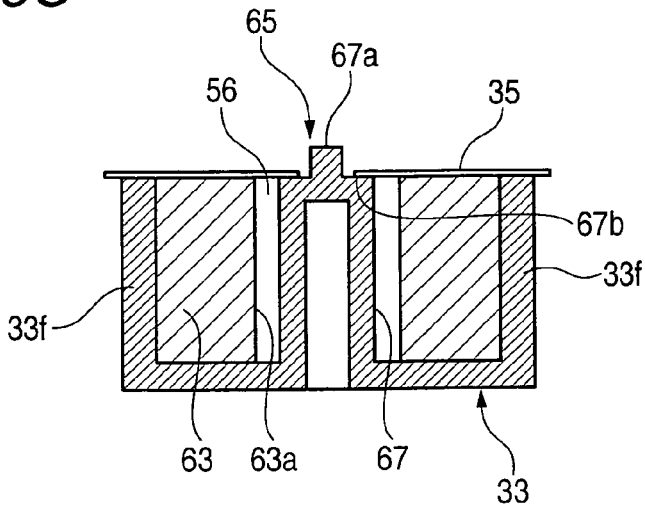

Subsequently, in the valve 65, if the pouring of waste ink ends and the pressure within the storage space 51 is reduced, as shown in FIG. 6C, the perimeter of the vent 61 is biased in a direction to be brought into contact with the contact surface 67*b* of the valve structure member 67 by a tension of the intermediate container wall 35 and the ink packs 11 to 13 that press and bias the intermediate container wall 35 downward. Then, the vent 61 is closed.

If the ink cartridge 10 is mounted on the cartridge mounting portion 9 of the ink jet printer 1, the ink supply needles 41 provided in the cartridge mounting portion 9 pass through the ink outlet ports 23 in an airtight manner, such that the ink liquids within the bag bodies 21 can be supplied to the printer through the ink supply needles 41. Supply tubes 42 that supply ink to a printing head (not shown) of the printer are connected to the ink supply needles 41, respectively.

Meanwhile, the waste ink pouring needle 47 provided in the cartridge mounting portion 9 is engaged with the rubber mouth member 37*a* in an airtight manner and presses the valve body 37*c* (see FIG. 4). Then, waste ink can be poured into the storage space 51 through the waste ink pouring needle 47.

A waste ink guiding tube 49 that guides waste ink generated at the time of an ink filling operation or a head cleaning operation of the ink jet printer 1 is connected to the waste ink pouring needle 47.

As shown in FIG. 4, a rear end of the waste ink inlet 44 (a right end in FIG. 4) is connected to the storage space 51. Then, waste ink poured from the waste ink pouring needle 47 inserted into the waste ink inlet portion 37 flows in the storage space 51 from the rear end of the waste ink inlet 44.

The ink absorption members 63 absorb poured waste ink so as to prevent waste ink poured into the storage space 51 through the waste ink inlet portion 37 and the waste ink inlet 44 from flowing backward to the waste ink inlet portion 37 and leaking to the outside.

If waste ink is poured into the storage space 51 that is kept airtight, an air pressure of the storage space 51 is increased, and thus the intermediate container wall 35 is lifted up. Then, a gap is formed between the intermediate container wall 35 and the contact surface 67*b*, air within the storage space 51 is released to the outside, and then the air pressure is decreased. Accordingly, the valve 65 is closed again. In such a manner, the valve 65 opens the vent 61 only when waste ink is poured so as to release air within the storage space 51. Therefore, there is no case where the pouring of waste ink from the waste ink inlet portion 37 is obstructed.

According to the waste ink storage structure 17 of this embodiment described above, the vent 61 that exposes the storage space 51 to the atmosphere is kept to be in a closed state by the valve 65 excluding when waste ink is poured from the waste ink inlet portion 37.

Therefore, moisture of waste ink poured into the storage space 51 is suppressed from being transpired from the vent 61 to the outside, and thus it is possible to prevent hardening of waste ink in the storage space 51. As a result, it is possible to prevent absorption capability of the ink absorption members 63 from being degraded due to hardening of waste ink.

Accordingly, even when pigment-based ink is used, the original absorption capability of the ink absorption members 63 can be fully utilized, and the ink absorption members 63 can be stably used to collect waste ink for a long time. Further, since clogging due to hardened waste ink does not occur, there is no case where a pressure in the waste ink guiding tube 49 on the waste ink supplying side connected to the waste ink inlet portion 37 and so on is abnormally increased. Therefore, the occurrence of an inconsistency such as light leakage or the like due to the removal of the waste ink guiding tube 49 or the like can be prevented.

In the waste ink storage structure 17 of the above-described embodiment, for example, when discarding a used ink cartridge 10, the upper case 31 and the lower case 33 are separated from each other, and the intermediate container wall 35 formed of a plastic film is removed from the lower case 33. Then, a surface of the storage space 51 can be largely opened, and thus the ink absorption members 63 having absorbed waste ink can be simply removed from the storage space 51.

Therefore, for the purpose of recycling or reusing the parts or materials, disassembling the used ink cartridge 10 and classifying by materials can be easily performed.

The valve structure member 67 is integrally formed on the bottom wall 33*i* at the position facing the vent 61 that is formed to pass through the intermediate container wall 35 formed of a plastic film. Then, the contact surface 67*b* of the valve structure member 67 comes into contact with the perimeter of the vent 61 so as to close the vent 61. With this configuration, the valve 65 opens/closes the vent 61 can be obtained. Therefore, parts for providing the valve 65 do not need to be added, and thus costs can be prevented from being increased due to an increase in the number of parts or an increase in the number of assembling steps.

In the ink cartridge 10 of the above-described embodiment, the intermediate container wall 35 having the vent 61 provided therein defines the ink pack accommodating space 55 that accommodates the ink packs 11 to 13, and the storage space 51.

Accordingly, the vent 61 is not directly exposed the outside of the ink cartridge 10, but is exposed to the atmosphere through the ink pack accommodating space 55 that accommodates the ink packs 11 to 13. Therefore, there is no case where a user unexpectedly touches the valve 65 provided at the vent 61 and causes a trouble in valve functions.

The perimeter of the valve structure member 67 has a space portion 56 so as not to come into contact with the ink absorption members 63. Therefore, a capillary force does not exert between the valve structure member 67 and the ink absorption members 63, and waste ink absorbed by the ink absorption members 63 does not move to the contact surface 67*b* through the valve structure member 67. Therefore, there is no case where waste ink flows out from the vent 61 unless waste ink exceeds the capability of the ink absorption members 63.

In this embodiment, the positioning protrusion 67*a* is provided at the contact portion of the valve structure member 67 to pass through the vent 61.

Therefore, at the time of assembling, positioning of the contact portion of the valve structure member 67 and the vent 61 of the intermediate container wall 35 can be easily performed, and thus assembling workability can be improved.

A structure of the ink cartridge having the waste ink storage structure of the invention is not limited to the ink cartridge 10 of the above-described embodiment. For example, the waste ink storage structure of the invention can be applied to various ink cartridges having a different ink pack support structure or a different number of ink packs.

In this embodiment, the valve structure member is formed integrally with the lower case. However, separate parts for the valve structure member may be provided on the lower case or the valve structure member may be formed by a circumferential portion of the lower case. In any case, what is necessary is that a surface for closing the vent is provided.

In the above-described embodiment, a case where the waste ink storage structure 17 is provided in the ink cartridge 10 that is detachably mounted on the ink jet printer 1 has been described. However, the waste ink storage structure of the invention is not limited to this configuration. Of course, various examples can be used.

Next, a second embodiment according to the invention will be described with reference to the drawings.

Figure 7:
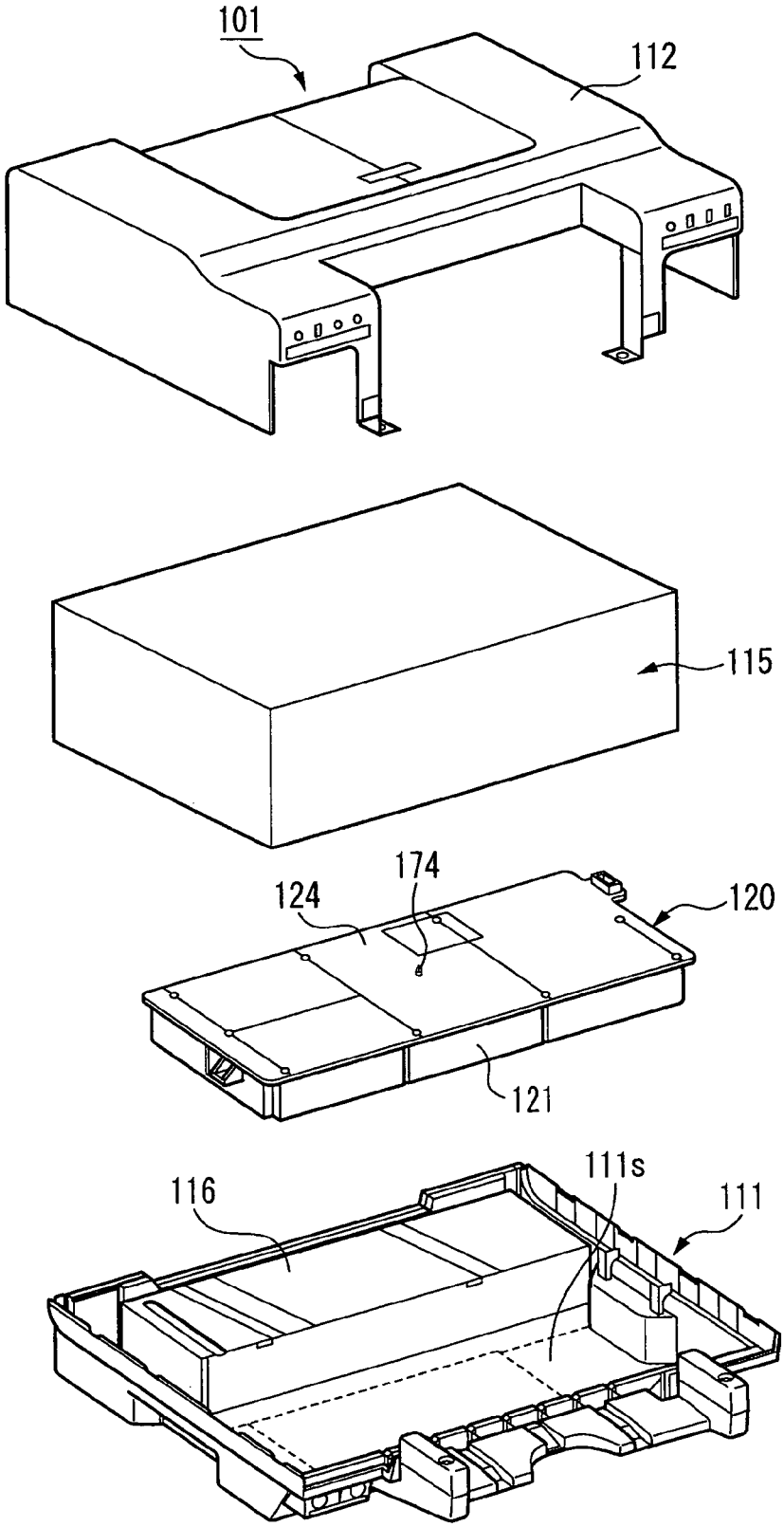
FIG. 7 is an exploded perspective view schematically showing the overall configuration of an ink jet printer on which a waste ink tank having the waste ink storage structure according to an embodiment of the invention is mounted.
Figure 8:
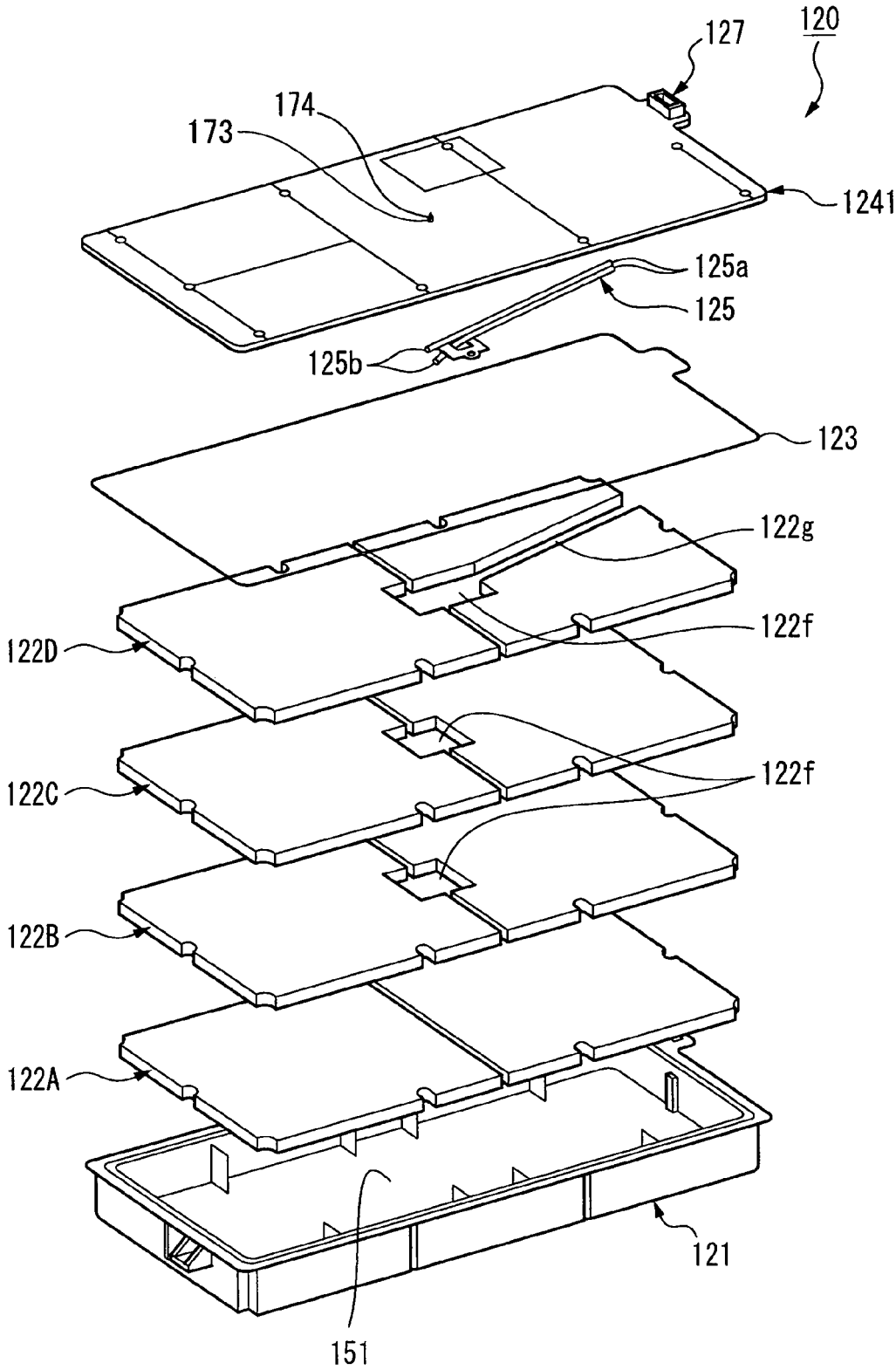
FIG. 8 is an exploded perspective view of the waste ink tank shown in FIG. 7.

FIG. 7 is an exploded perspective view schematically showing the overall configuration of an ink jet printer on which a waste ink tank having a waste ink storage structure is provided. FIG. 8 is an exploded perspective view of a waste ink tank shown in FIG. 7. FIG. 9 is an expanded cross-sectional view of a valve shown in FIG. 8.

As shown in FIG. 7, an ink jet printer 101 of this embodiment has a printer housing 111 that is to be a bottom casing, a waste ink tank 120 that is detachably provided in a tank accommodating portion ills defined at a bottom portion within the printer housing 111 and has a rectangular shape in plan view, a printer mechanism section 115 that is disposed above the printer housing 111 and the waste ink tank 120, and an exterior cover 112 that is to be a top casing. Further, a power supply unit 116 is provided at the back of the tank accommodating portion ills that accommodates the waste ink tank 120.

As shown in FIG. 8, the waste ink tank 120 of this embodiment has a boxlike tank main body 121 that replaceably accommodates an ink absorption member 122 for absorbing waste ink poured into a storage space 151, and a lid body 124 that covers an upper opening of the tank main body 121. Portions of the tank main body 121 and the lid body 124 to be bonded are pressed into contact with each other through a sealing member 123, such as a rubber packing or the like, and is sealed fluid-tight.

Tubes 125 are provided on the rear surface of the lid body 124 so as to guide waste ink from an ink receiving port 127 of a tank circumferential portion to a tank central portion and cause waste ink to drip on an upper central portion of the ink absorption member 122. A color of a plastic part constituting the waste ink tank 120 is a dark color, for example, black such that waste ink to be stored is not visible.

The waste ink tank 120 is fitted and screwed to the tank accommodating portion ills on the printer housing 111, and an ejection port of an absorption pump (not shown) for head cleaning and front end inlet ports 125*a* of the tubes 125 are connected to each other on the waste ink tank 120, such that the waste ink tank 120 is set on the printer housing 111. Further, when removing the waste ink tank 120, a reverse operation is performed, such that the waste ink tank 120 can be removed from the printer housing 111.

The ink absorption member 122 is a laminate that is formed by laminating multi-stage (in the drawing, four-stage) thin plate molded bodies formed of a nonwoven fabric or felt from the uppermost layer to the lowermost layer (122A to 122D). Further, a center hole 122*f* is provided at a planar center of each of the three-stage ink absorption members 122B to 122D, excluding the lowermost ink absorption member 122A, so as to vertically pass therethrough. In the uppermost ink absorption member 122D, a tube accommodating groove 122*g* that extends from its circumferential portion to the center hole 122*f* is formed.

Then, the tubes 125 are accommodated in the tube accommodating groove 122*g* formed in the uppermost ink absorption member 122D, and the front end inlet ports 125*a* of the tubes 125 are positioned in the ink receiving port 127 provided at the circumferential portion of the lid body 124. Simultaneously, front end outlet ports 125*b* of the tubes 125 are positioned within the center hole 122*f* of the uppermost ink absorption member 122D.

That is, the waste ink tank 120 of this embodiment has, in the lid body 124, the waste ink storage structure 17 provided with the ink receiving port 127 that is to be a waste ink inlet portion for pouring waste ink into the storage space 151, and a vent 173 that exposes the storage space 51 to the atmosphere. The lid body 124 serves as a container wall that defines the storage space 151 for storing waste ink generated at the time of an ink filling operation or a head cleaning operation of the printer. The vent 173 is located at a central portion of the lid body 124, as shown in FIG. 8. The vent 173 is disposed at a center of the center hole 122*f* so as not to come into contact with the ink absorption member 122.

As shown in FIG. 9, a valve 171 that is opened only when waste ink is poured is provided at the vent 173 formed in the lid body 124. A valve body 174 of the valve 171 that closes the vent 173 formed in the lid body 124 is integrally molded by an elastic member having open/close portions 174*c* that are elastically displaced in an opening direction by a pouring pressure of waste ink from the ink receiving port 127.

The valve body 174 has a brim portion 174*a* that is closely bonded to the circumferential portion of the vent 173, a cylindrical portion 174*b* that passes through the vent 173 from the inner circumferential portion of the brim portion 174*a*, and a plurality of open/close portions 174*c* that are formed by providing a widthwise notch 174*d* at a conical portion extending from the front end of the cylindrical portion 174*b* so as to close the front end of the cylindrical portion 174*b*. The brim portion 174*a*, the cylindrical portion 174*b*, and the open/close portions 174*c* are integrally formed using a rubber material.

Figure 9A:
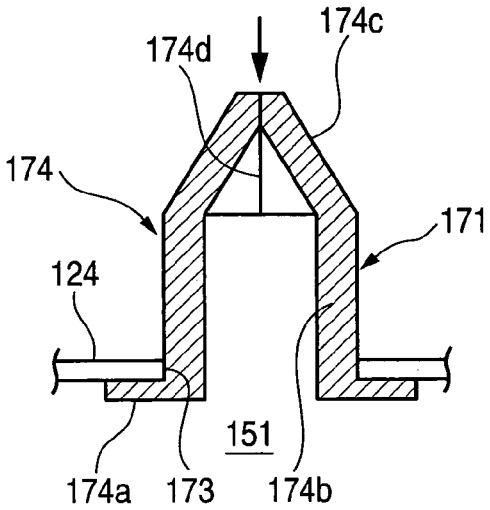
FIG. 9 is an expanded cross-sectional view of a valve shown in FIG. 8.
Figure 9B:
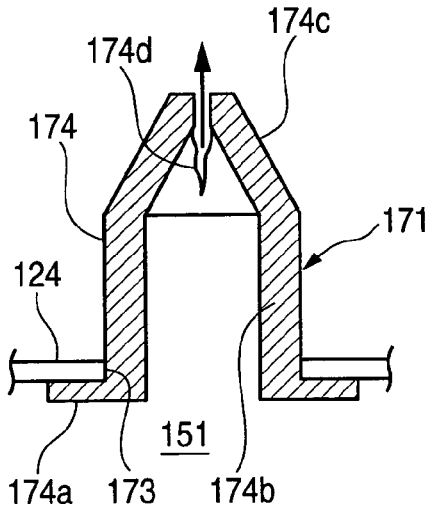

The open/close portions 174*c* of the valve 171 are closed when waste ink is not poured, as shown in FIG. 9A. Meanwhile, when waste ink is poured, as shown in FIG. 9B, the open/close portions 171 are elastically displaced in the opening direction by the pouring pressure of waste ink from the ink receiving port 127, and the notch 174*d* is opened. Then, air within the storage space 151 is released to the outside.

Accordingly, an exclusive-use valve body 174 constituting the valve 171 needs to be provided. However, by suitably setting elasticity in the open/close portions 174*c* of the valve body 174, sealing capability of the vent 173 by the valve 171 can be improved, and also capability for preventing transpiration of moisture from the vent 173 can be improved.

A material for the lid body 124 having the vent 173 provided therein is not limited. Therefore, a degree of freedom for design of the waste ink tank 120 having the waste ink storage structure can be improved.

According to the waste ink tank 120 of the above-described embodiment, moisture of waste ink poured into the storage space 151 is suppressed from being transpired from the vent 173 to the outside. Therefore, it is possible to obtain a waste ink tank that can prevent hardening of waste ink in the storage space 151, and can prevent absorption capability of the ink absorption member 122 from being degraded due to hardening of waste ink.

In the ink jet printer 101 of this embodiment, only the waste ink tank 120 can be independently removed from the printer housing 111. Therefore, only the waste ink tank 120 that is stained with ink can be separately managed, and the non-stained printer housing 111 can be recycled or reused as it is. In addition, since the waste ink tank 120 is detachably provided, in a certain situation, a worker can replace only the waste ink tank 120 with a new one without staining his/her hands.

According to this embodiment, when discarding the used waste ink tank 120, disassembling can be simply performed by opening the lid body 124, removing the ink absorption member 122 having absorbed waste ink from the tank main body 121, and then removing the valve body 174 or the tubes 125 from the lid body 124.

Therefore, for the sake of recycling or reusing the parts or materials, works for disassembling the used waste ink tank 120 and classifying by materials can be easily performed.

The configuration of the valve, into which the valve body having the open/close portions to be opened by the pouring pressure of waste ink from the waste ink inlet portion is incorporated, is not limited to the configuration of the valve 171. Of course, various examples can be used.

Figure 10:
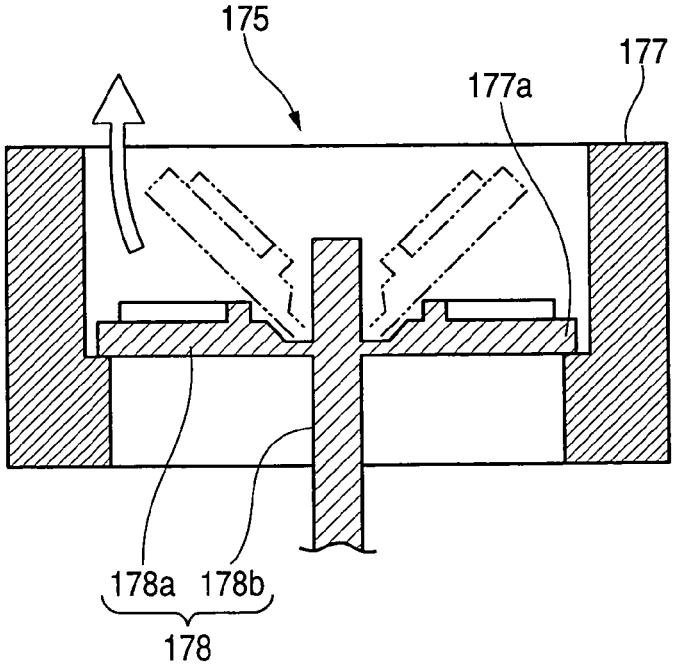
FIG. 10 is a longitudinal cross-sectional view showing another configuration example of a valve according to the invention.

A valve 175 shown in FIG. 10 has a cylindrical valve seat 177 that is threaded and fixed in a vent of a contain wall (not shown), and a valve body 178 that is seated on the valve seat 177.

The valve seat 177 sets a contact surface 177*a* formed in an inner circumferential surface of a cylinder as a seating surface of the valve body 178. In the valve body 178, a disc-shaped valve main body 178*a*, an outer circumferential portion of which is seated on the contact surface 177*a*, and a support portion 178*b* that supports a central portion of the valve main body 178*a* are integrally formed using an elastic material.

As indicated by a two-dot-chain line in the drawing, the outer circumferential portion of the valve main body 78*a* is elastically displaced in a direction to be spaced away from the valve seat 77 according to an increase in pressure of the storage space when waste ink is poured. Then, as indicated by a solid line in the drawing, air of the storage space can be released from a gap, which is to be formed when the valve main body 78*a* is elastically displaced, to the outside.

What is claimed is:

1. A waste ink storage structure comprising:

container walls, defining a storage space adapted to store a waste ink, and provided with a waste ink inlet portion adapted to pour the waste ink into the storage space and a vent communicating the storage space with atmosphere; and a valve, provided at the vent to be opened when the waste ink is poured from the waste ink inlet portion.

2. The waste ink storage structure according to claim 1, further comprising an ink absorption member, provided in the storage space and adapted to absorb the waste ink.

3. The waste ink storage structure according to claim 1, wherein the container walls include a flexible container wall formed of a flexible sheet member provided with the vent, and wherein the valve has: the flexible container wall; and a valve structure member having a contact portion which comes into contact with a perimeter of the vent to block the vent, and is constructed such that the vent is opened when the perimeter of the vent displaces and separates from the contact portion by a pouring pressure of the waste ink poured from the waste ink inlet portion.

4. The waste ink storage structure according to claim 3, wherein an ink absorption member is spaced away from a periphery of the contact portion of the valve structure member.

5. The waste ink storage structure according to claim 3, wherein the vent is disposed on a central line of a short side of the flexible container wall.

6. The waste ink storage structure according to claim 3, wherein the contact portion of the valve structure member is provided with a protrusion passing through the vent of the flexible sheet member.

7. The ink cartridge according to claim 3, wherein the container walls include a flexible container wall formed of a flexible sheet member provided with the vent, and the flexible container wall defines an accommodating space accommodating the ink pack and the storage space.

8. The ink cartridge according to claim 7, wherein the vent is provided at a position that does not interfere with the ink pack.

9. The waste ink storage structure according to claim 3, wherein said contact portion is positioned at a same height or a slightly higher height than upper end surfaces of a side container wall and front and rear container walls.

10. The waste ink storage structure according to claim 9, wherein a height of the ink absorption member is equal to or slightly lower than a height of said upper end surfaces of the side container wall and front and rear container walls.

11. The waste ink storage structure according to claim 3, wherein the valve structure member is integrally formed on a bottom wall of a lower case of said waste ink storage structure.

12. The waste ink storage structure according to claim 1, wherein a valve body of the valve to block the vent is integrally formed with an elastic member having an open-close portion elastically displaceable in an opening direction by a pouring pressure of the waste ink poured from the waste ink inlet portion.

13. An ink cartridge comprising: the waste ink storage structure according to claim 1; and an ink pack adapted to store ink therein.

14. The ink cartridge according to claim 13, wherein the ink is pigment-based ink.

15. An ink jet printer comprising the ink cartridge according to claim 13.

16. The waste ink storage structure according to claim 13, wherein said vent is exposed to an ink pack accommodating space that accommodates said at least one ink pack.

17. A waste ink tank comprising the waste ink storage structure according to claim 1.

18. An ink jet printer comprising the waste ink tank according to claim 17.

19. The ink jet printer according to claim 18, wherein the waste ink tank is detachably mounted in a tank accommodating portion of a printer housing.

20. The waste ink storage structure according to claim 1, wherein the vent is disposed along a central line in a widthwise direction of said waste ink storage structure.

21. The waste ink storage structure according to claim 1, wherein said storage space includes a tank main body that accommodates an ink absorption member; a lid body that covers said tank main body; and a sealing member that seals said lid body to said tank main body.

22. The waste ink storage structure according to claim 21, further including tubes provided on said lid body to guide ink from said waste ink inlet portion to said ink absorption member.

23. The waste ink storage structure according to claim 22, wherein said ink absorption member comprises a plurality of layers, each layer having a center and an uppermost layer includes a groove that accommodates said tubes.

24. The waste ink storage structure according to claim 23, wherein said lid body includes a vent located at a central position thereof and at a center portion of a center hole.

25. The waste ink storage structure according to claim 24, wherein said valve includes open/close portions that are elastically displaced by a pouring pressure caused by waste ink poured at said waste ink inlet portion; a brim portion; and a cylindrical portion, said open/close portions forming a notch, wherein when waste ink is poured from said waste ink inlet portion, said notch is opened.

26. The waste ink storage structure according to claim 25, wherein said brim portion, said cylindrical portion and said open/close portions are integrally formed.

27. The waste ink storage structure according to claim 26, wherein only a waste ink tank can be independently removed.

28. The waste ink storage structure according to claim 25, wherein said valve includes a cylindrical valve seat that is threadedly fixed to a vent of a container wall.

29. The waste ink storage structure of claim 1, wherein a pressure within the storage space increases according to pouring of the waste ink.

* * * * *